US009162844B2

(12) United States Patent
Kakutani et al.

(10) Patent No.: US 9,162,844 B2
(45) Date of Patent: Oct. 20, 2015

(54) IMAGE FORMING SYSTEM HAVING MOVABLE STAPLER, SHEET POST-PROCESSING APPARATUS, AND CONTROL METHOD

(71) Applicant: CANON KABUSHIKI KAISHA, Tokyo (JP)

(72) Inventors: Toshifumi Kakutani, Abiko (JP); Kazumi Sato, Kashiwa (JP); Takeyuki Suda, Nagareyama (JP); Yousuke Hata, Ichikawa (JP); Hirohisa Kato, Toride (JP); Shinya Suzuki, Toride (JP); Yoshitaka Yamazaki, Abiko (JP)

(73) Assignee: CANON KABUSHIKI KAISHA (JP)

( * ) Notice: Subject to any disclaimer, the term of this patent is extended or adjusted under 35 U.S.C. 154(b) by 78 days.

(21) Appl. No.: 14/183,866

(22) Filed: Feb. 19, 2014

(65) Prior Publication Data

US 2014/0239571 A1 Aug. 28, 2014

(30) Foreign Application Priority Data

Feb. 25, 2013 (JP) ..... 2013-034813

(51) Int. Cl.

| | |
|---|---|
| ***B65H 37/04*** | (2006.01) |
| ***B65H 43/00*** | (2006.01) |
| ***G03G 15/00*** | (2006.01) |

(52) U.S. Cl.

CPC ..... *B65H 43/00* (2013.01); *B65H 37/04* (2013.01); *G03G 15/5004* (2013.01); *B65H 2407/21* (2013.01); *B65H 2408/1222* (2013.01); *B65H 2511/20* (2013.01); *B65H 2511/51* (2013.01); *B65H 2801/27* (2013.01); *G03G 15/6538* (2013.01); *G03G 2221/1696* (2013.01)

(58) Field of Classification Search

CPC ..... B65H 37/04
USPC ..... 270/58.08, 58.09; 399/410
See application file for complete search history.

(56) References Cited

U.S. PATENT DOCUMENTS 7,407,156 B2 8/2008 Iizuka et al.

*Primary Examiner* — Patrick Mackey
(74) *Attorney, Agent, or Firm* — Rossi, Kimms & McDowell LLP

(57) ABSTRACT

An image forming system which is capable of, when a manual stapling process is to be carried out on sheets, reducing waiting time for a user and decreasing power consumption. The image forming system has an image forming apparatus, which forms images on sheets, and a sheet post-processing apparatus. When the sheet post-processing apparatus is to shift into a power-saving state, a movable stapler is moved to a manual stapling position. When it is detected that sheets have been set into a sheet setting unit in a state in which the image forming apparatus and the sheet post-processing apparatus have shifted into the power-saving state, the image forming apparatus is held in the power-saving state, and the sheet post-processing apparatus is returned from the power-saving state.

11 Claims, 10 Drawing Sheets

| | IMAGE FORMING APPARATUS MAIN BODY | POST-PROCESSING APPARATUS |
|---|---|---|
| STATE 1 | STANDBY | STANDBY |
| STATE 2 | POWER-SAVING | STANDBY |
| STATE 3 | STANDBY | POWER-SAVING |
| STATE 4 | POWER-SAVING | POWER-SAVING |

*FIG. 5*

| | IMAGE FORMING APPARATUS MAIN BODY | POST-PROCESSING APPARATUS |
|---|---|---|
| STATE 1 | STANDBY | STANDBY |
| STATE 2 | POWER-SAVING | STANDBY |
| STATE 3 | STANDBY | POWER-SAVING |
| STATE 4 | POWER-SAVING | POWER-SAVING |

IMAGE FORMING SYSTEM HAVING MOVABLE STAPLER, SHEET POST-PROCESSING APPARATUS, AND CONTROL METHOD

BACKGROUND OF THE INVENTION

1. Field of the Invention

The present invention relates to an image forming system having a stapler that staples sheets, a sheet post-processing apparatus, and a control method therefor.

2. Description of the Related Art

Conventionally, as apparatuses that staple sheets on which images have been formed by image forming apparatuses such as copiers and printers, post-processing apparatuses equipped with a stapling mechanism that staples a sheet bundle comprised of a plurality of stacked sheets using stapling members such as metallic staples have been widely used. Generally, in a post-processing apparatus of this type, a user sets automatic stapling as an operation mode in image formation from an operation unit of the post-processing apparatus, and the post-processing apparatus automatically carries out a stapling process on a sheet bundle conveyed from an image forming apparatus to the post-processing apparatus. On the other hand, there is also a demand to, aside from an automatic stapling process, carry out a stapling process on a sheet bundle through a manual operation by a user independently of an image forming operation.

As an example of techniques to carry out a stapling process on a sheet bundle by the manual operation, a technique to carry out a stapling process on a sheet bundle by performing a manual operation in which a user inserts the sheet bundle from an opening (sheet discharge port) of a post-processing apparatus (see, for example, U.S. Pat. No. 7,407,156).

According to the technique described in U.S. Pat. No. 7,407,156, when a stapling process is carried out on a sheet bundle by the manual operation, a user accesses the post-processing apparatus from a side thereof on which the opening (sheet discharge port) is provided, and hence it is uneasy for the user to operate the post-processing apparatus. With consideration given to the ease of operation for the user, it is more preferable to access the post-processing apparatus from a front surface thereof. Accordingly, it is conceivable to provide an insertion slot for a sheet bundle in the front surface of the post-processing apparatus.

In a case where a stapling process is to be carried out on only one place at a corner of a sheet bundle, it is unnecessary to insert the sheet bundle to a rear of the post-processing apparatus, and the stapling process is carried out by merely inserting a part of the sheet bundle, on which the stapling process is to be carried out, into an insertion slot provided in a front surface of the post-processing apparatus. Therefore, as compared to a post-processing apparatus configured such that a sheet bundle is inserted into an opening (sheet discharge port) on a side of the post-processing apparatus as described in U.S. Pat. No. 7,407,156, a post-processing apparatus configured such that a sheet bundle is inserted into an insertion slot in a front surface of the post-processing apparatus can enhance the ease of operation for a user.

However, in the case where the stapling process described above is carried out on a sheet bundle, a position at which a stapling mechanism that staples a sheet bundle stands by presents a problem. Ordinarily, there is one stapling mechanism mounted in the post-processing apparatus, and by moving this stapling mechanism, stapling on various places of a sheet bundle can be realized.

This stapling mechanism stands by at a position different from a standby position, which is used in the case of a stapling process manually carried out by a user, considering that a print job in which an image forming process and a stapling process are carried out on sheets by an image forming apparatus having a post-processing apparatus. For this reason, in a case where a user is to carry out a stapling process by a manual operation (manual stapling process), the user has to wait until the stapling mechanism has been moved to the standby position for the manual operation.

Further, if the manual stapling process is to be carried out in a state where the image forming apparatus is in a power-saving state in which power consumption is minimized, a problem explained hereafter will arise. The waiting time that elapses before the manual stapling process is carried out is long due to the need to detect a home position of the stapling mechanism, the need to move the stapling mechanism, and so on, and this stresses the user out.

SUMMARY OF THE INVENTION

The present invention provides an image forming system, a sheet post-processing apparatus, and a control method therefor, which are capable of, when a stapling process is to be carried out on sheets by a manual operation, reducing waiting time for a user and decreasing power consumption.

Accordingly, a first aspect of the present invention provides an image forming system having an image forming apparatus, which forms images on sheets, and a sheet post-processing apparatus, which carries out a stapling process on the sheets having the images formed thereon by the image forming apparatus, and is configured to be able to shift into a power-saving state in which power consumption is lower than in a standby state in which image formation is not performed, comprising a stapling unit configured to be able to carry out a manual stapling process in which sheets set by a manual operation are stapled independently of an image forming operation and an automatic stapling process in which sheets are stapled associated with the image forming operation, and to move along a path including a manual stapling position for the manual stapling process and an automatic stapling position for the automatic stapling process, a sheet setting unit into which the sheets on which the manual stapling process is to be carried out are set, a detection unit configured to detect that the sheets have been set into the sheet setting unit, a movement control unit configured to move the stapling unit to the manual stapling position when the sheet post-processing apparatus is to shift into the power-saving state, and a power control unit configured to, when it is detected that the sheets have been set into the sheet setting unit by the detection unit in a state in which the image forming apparatus and the sheet post-processing apparatus have shifted into the power-saving state, hold the image forming apparatus in the power-saving state and return the sheet post-processing apparatus from the power-saving state.

Accordingly, a second aspect of the present invention provides a sheet post-processing apparatus that is configured to be able to shift into a power-saving state in which power consumption is lower than in a standby state in which image formation is not performed, comprising a stapling unit configured to carry out a manual stapling process in which sheets set by a manual operation are stapled independently of an image forming operation and an automatic stapling process in which sheets are stapled associated with the image forming operation, and to move along a path including a manual stapling position for the manual stapling process and an automatic stapling position for the automatic stapling process, a sheet setting unit into which the sheets on which the manual stapling process is to be carried out are set, a detection unit configured to detect that the sheets have been set into the sheet setting unit, and a movement control unit configured to move the stapling unit to the manual stapling position when the sheet post-processing apparatus is to shift into the power-saving state, and wherein in a case where it is detected that the sheets have been set into the sheet setting unit by the detection unit in a state in which the image forming apparatus and the sheet post-processing apparatus have shifted into the power-saving state, the sheet post-processing apparatus returns from the power-saving state independently of the image forming apparatus.

Accordingly, a third aspect of the present invention provides a control method for an image forming system having an image forming apparatus which forms images on sheets, and a sheet post-processing apparatus which is configured to be able to shift into a power-saving state in which power consumption is lower than in a standby state in which image formation is not performed, the sheet post-processing apparatus having a stapling unit configured to be able to carry out a manual stapling process in which sheets set by a manual operation are stapled independently of the image forming operation and an automatic stapling process in which sheets are stapled associated with the image forming operation, and to move along a path including a manual stapling position for the manual stapling process and an automatic stapling position for the automatic stapling process, a sheet setting unit into which the sheets on which the manual stapling process is to be carried out are set, and a detection unit configured to detect that the sheets have been set into the sheet setting unit, the control method comprising a movement control step of moving the stapling unit to the manual stapling position when the sheet post-processing apparatus is to shift into the power-saving state, and a power control step of, when it is detected that the sheets have been set into the sheet setting unit by the detection unit in a state in which the image forming apparatus and the sheet post-processing apparatus have shifted into the power-saving state, holding the image forming apparatus in the power-saving state and returning the sheet post-processing apparatus from the power-saving state.

According to the present invention, when the sheet post-processing apparatus is to shift into the power-saving state, the stapling unit is moved to the manual stapling position. When setting of sheets, on which the stapling process is to be carried out by the manual operation, into the sheet setting unit is detected, the sheet post-processing apparatus is returned from the power-saving state. As a result, the time period for which the user has to wait when carrying out the stapling process on sheets by the manual operation can be reduced, and also, power consumption can be decreased.

Further features of the present invention will become apparent from the following description of exemplary embodiments (with reference to the attached drawings).

BRIEF DESCRIPTION OF THE DRAWINGS

FIGS. 2A and 2B are schematic diagrams showing an exemplary placement of the post-processing apparatus with respect to the image forming apparatus main body, in which FIG. 2A is a schematic diagram showing an example in which the post-processing apparatus is placed in a space for sheet discharge of the image forming apparatus main body, and FIG. 2B is a schematic diagram showing an example in which the post-processing apparatus is placed outside the image forming apparatus main body.

FIG. 5 is a diagram showing a power-saving state and a standby state of the image forming apparatus main body and the post-processing apparatus.

DESCRIPTION OF THE EMBODIMENTS

The present invention will now be described in detail with reference to the drawings showing an embodiment thereof.

Figure 1:
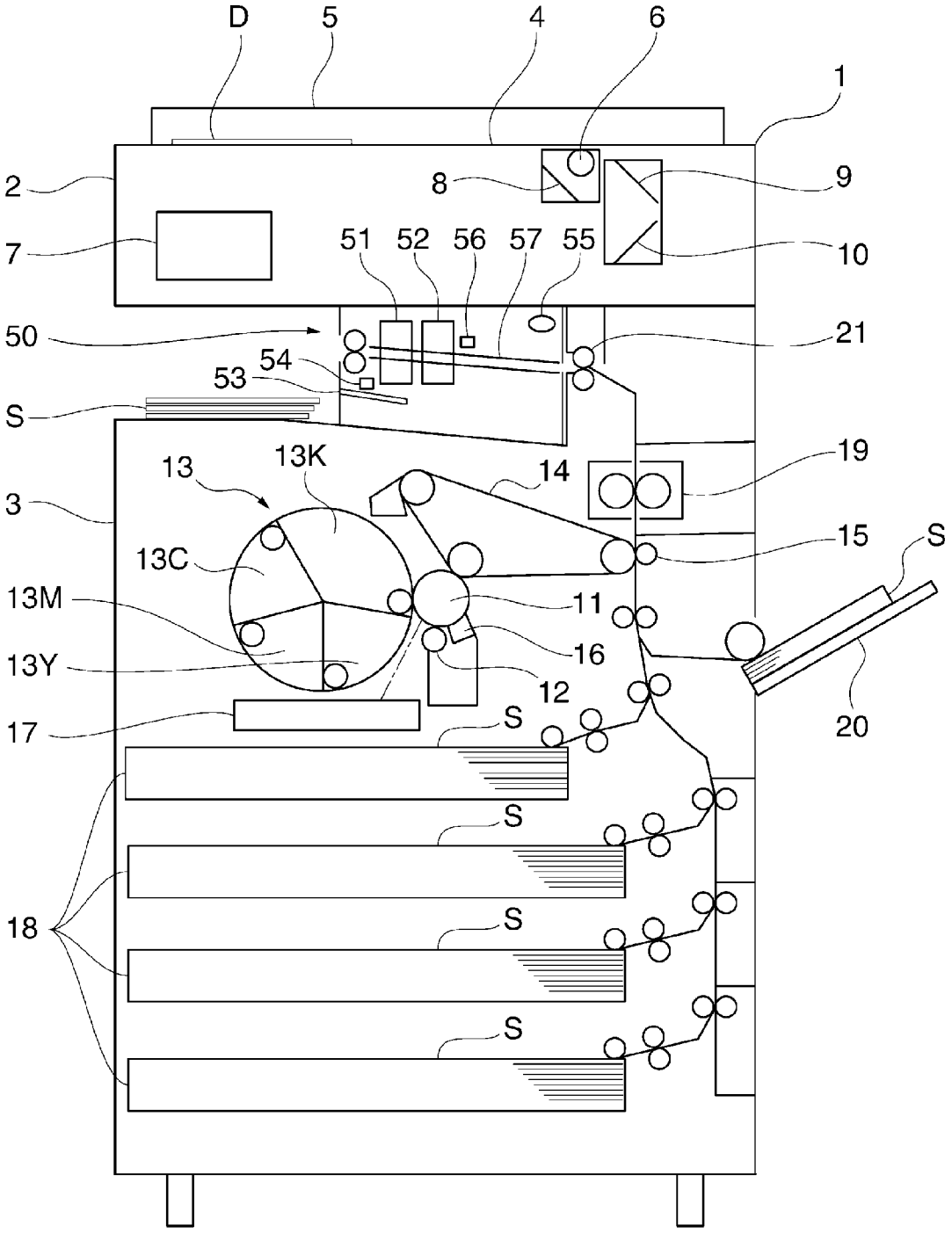
FIG. 1 is a diagram schematically showing arrangements of an image forming apparatus main body and a post-processing apparatus according to an embodiment of the present invention.
Figure 2A:
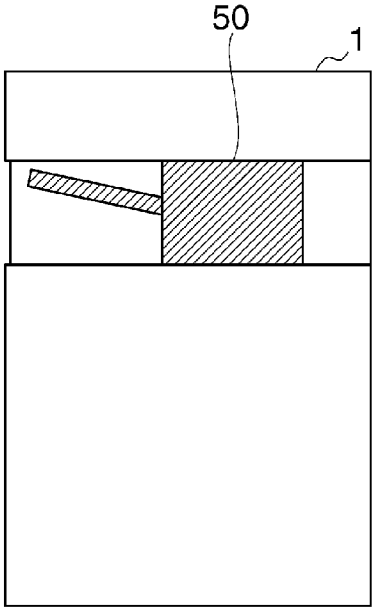
Figure 2B:
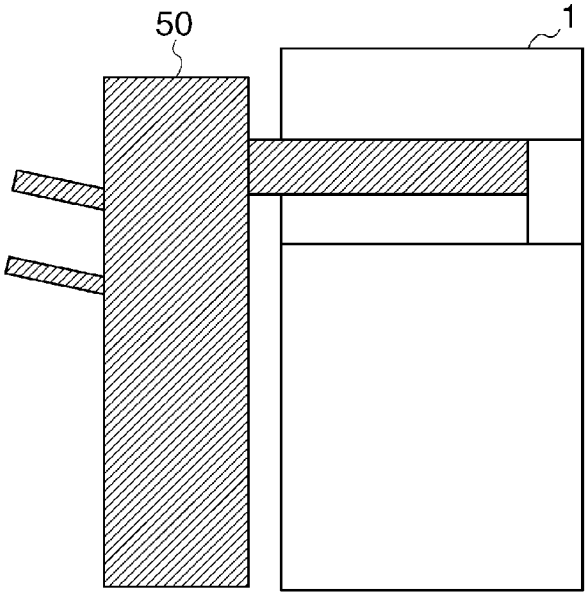

FIG. 1 is a diagram schematically showing arrangements of an image forming apparatus main body and a post-processing apparatus according to an embodiment of the present invention. FIGS. 2A and 2B are schematic diagrams showing an exemplary placement of the post-processing apparatus with respect to the image forming apparatus main body, in which FIG. 2A is a schematic diagram showing an example in which the post-processing apparatus is placed in a space for sheet discharge of the image forming apparatus main body, and FIG. 2B is a schematic diagram showing an example in which the post-processing apparatus is placed outside the image forming apparatus main body.

Referring to FIG. 1, the image forming apparatus 100 is comprised of the image forming apparatus main body 1 and the post-processing apparatus 50 placed in a space for sheet discharge (an interior of the main body) of the image forming apparatus main body 1 (FIG. 2A). It should be noted that the image forming apparatus main body 1 should not necessarily be configured such that the post-processing apparatus 50 is placed in the space for sheet discharge of the image forming apparatus main body 1, and may be configured such that the post-processing apparatus 50 is placed outside the image forming apparatus main body 1 as shown in FIG. 2B.

First, a description will be given of the image forming apparatus main body 1. The image forming apparatus main body 1 is comprised of an image reading unit 2 that reads an image off an original, and an image forming unit 3 that forms images on sheets. An original platen glass 4 made of a transparent glass sheet is fixed to an upper portion of the image reading unit 2. An original D is placed at a predetermined position on the original platen glass 4 with an image surface facing down, and urged and fixed by an original press-fit plate 5, so that an image is read off the original D. An optical system comprised of a lamp 6, which illuminates the original D, and reflective mirrors 8, 9, and 10 that guide an original image of the illuminated original D to an image processing unit 7 is provided below the original platen glass 4. It should be noted that the lamp 6 and the reflective mirrors 8, 9, and 10 move at a predetermined speed to scan the original D.

The image forming unit 3 has a photosensitive drum 11, a primary charging roller 12, a rotary developing unit 13, an intermediate transfer belt 14, a transfer roller 15, a cleaner 16, and so on. The photosensitive drum 11 is irradiated with laser light from a laser unit 17 based on image data obtained by reading an original, and an electrostatic latent image is formed on a surface of the photosensitive drum 11. The primary charging roller 12 uniformly charges the surface of the photosensitive drum 11 with electricity before irradiation of laser light.

The rotary developing unit 13 attaches toners of magenta (M), cyan (C), yellow (Y), and black (K) colors to the electrostatic latent image formed on the surface of the photosensitive drum 11 to form toner images. The toner images developed on the surface of the photosensitive drum 11 are transferred onto the intermediate transfer belt 14, and the toner images on the intermediate transfer belt 14 are transferred onto a sheet S by the transfer roller 15. The cleaner 16 removes toner remaining on the photosensitive drum 11 after the toner images are transferred onto the photosensitive drum 11.

The rotary developing unit 13, which is a rotary development type, has a developing device 13K, a developing device 13Y, a developing device 13M, and a developing device 13C, and is able to be rotated by a motor (not shown). To form a monochrome toner image on the photosensitive drum 11, the developing device 13K is moved while rotating to a development position close to the photosensitive drum 11, and development is carried out. Likewise, to form full-color toner images, the rotary development unit 13 is rotated to place the developing devices at development positions, and development is carried out on a color-by-color basis.

The sheet S onto which the toner images on the intermediate transfer belt 14 are to be transferred is supplied from a sheet feed cassette 18 or a manual feed tray 20 to a transfer position. A fixing unit 19, which is provided downstream of the transfer roller 15, fixes the toner images on the sheet S being conveyed. The sheet S with the toner images fixed thereon is discharged from the image forming apparatus main body 1 to the downstream-side post-processing apparatus 50 by a discharging roller pair 21.

A description will now be given of the post-processing apparatus 50. The post-processing apparatus 50 is connected to a sheet discharging unit of the image forming apparatus main body 1 and configured to be capable of communicating with the image forming apparatus main body 1 via a signal line (not shown). By communicating with the image forming apparatus main body 1, the post-processing apparatus 50 works in cooperation with the image forming apparatus main body 1. The post-processing apparatus 50 has a movable stapler 51, which carries out stapling on the sheets S discharged from the image forming apparatus main body 1 using staples, and a stapleless stapler (hereafter referred to as the eco stapler) 52 which carries out stapling without using staples.

The post-processing apparatus 50 has an alignment unit sheet sensor 56 that detects the presence or absence of the sheets S, and a sheet alignment unit 57 that aligns the sheets S. The sheets S discharged to the sheet alignment unit 57 are detected by the alignment unit sheet sensor 56, and the movable stapler 51 is operated to carry out a stapling process (staple stapling process) or the eco stapler 52 is operated to carry out a stapling process (stapleless stapling process) in accordance with a processing method determined in advance by a user. It should be noted that the post-processing apparatus 50 should not necessarily be equipped with the eco stapler 52.

The post-processing apparatus 50 also has a sheet insertion slot 53 for manual staple and a manual staple sheet sensor 54. The sheet insertion slot 53 is an insertion slot into which the user inserts sheets and staples the sheets by the manual operation. The manual staple sheet sensor 54 detects insertion of sheets into the sheet insertion slot 53.

When the manual staple sheet sensor 54 detects sheets, a manual stapling process is enabled through operation of a manual staple execution button 55. By the user depressing the manual staple execution button 55, the manual stapling process is carried out on the sheets by the movable stapler 51.

Figure 3:
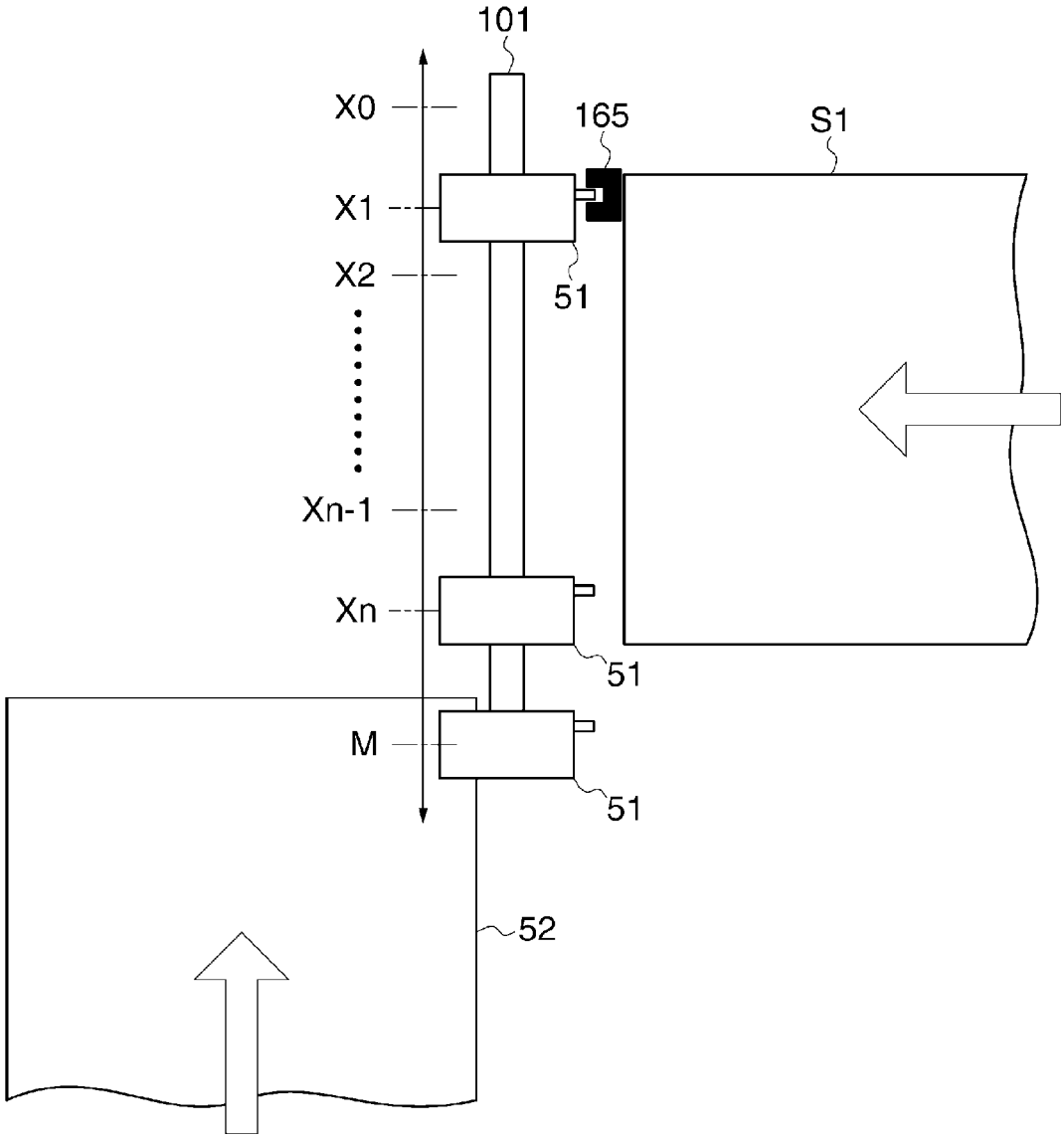
FIG. 3 is a diagram showing positions to which a movable stapler of the post-processing apparatus moves.

FIG. 3 is a diagram schematically showing positions to which the movable stapler 51 of the post-processing apparatus moves.

FIG. 3 shows a cross-section of the post-processing apparatus 50 as viewed from above. A lower side in FIG. 3 corresponds to a front side of the image forming apparatus main body 1. The movable stapler 51 is provided so as to be movable in a direction of an arrow along a moving path 101. The movable stapler 51 has two roles. The first role of the movable stapler 51 is to carry out automatic stapling in which it staples sheets S1, which are discharged from the image forming apparatus main body 1, at a predetermined position. The second role of the movable stapler 51 is to carry out manual stapling in which it staples sheets S2 inserted into the sheet insertion slot 53.

Figure 4:
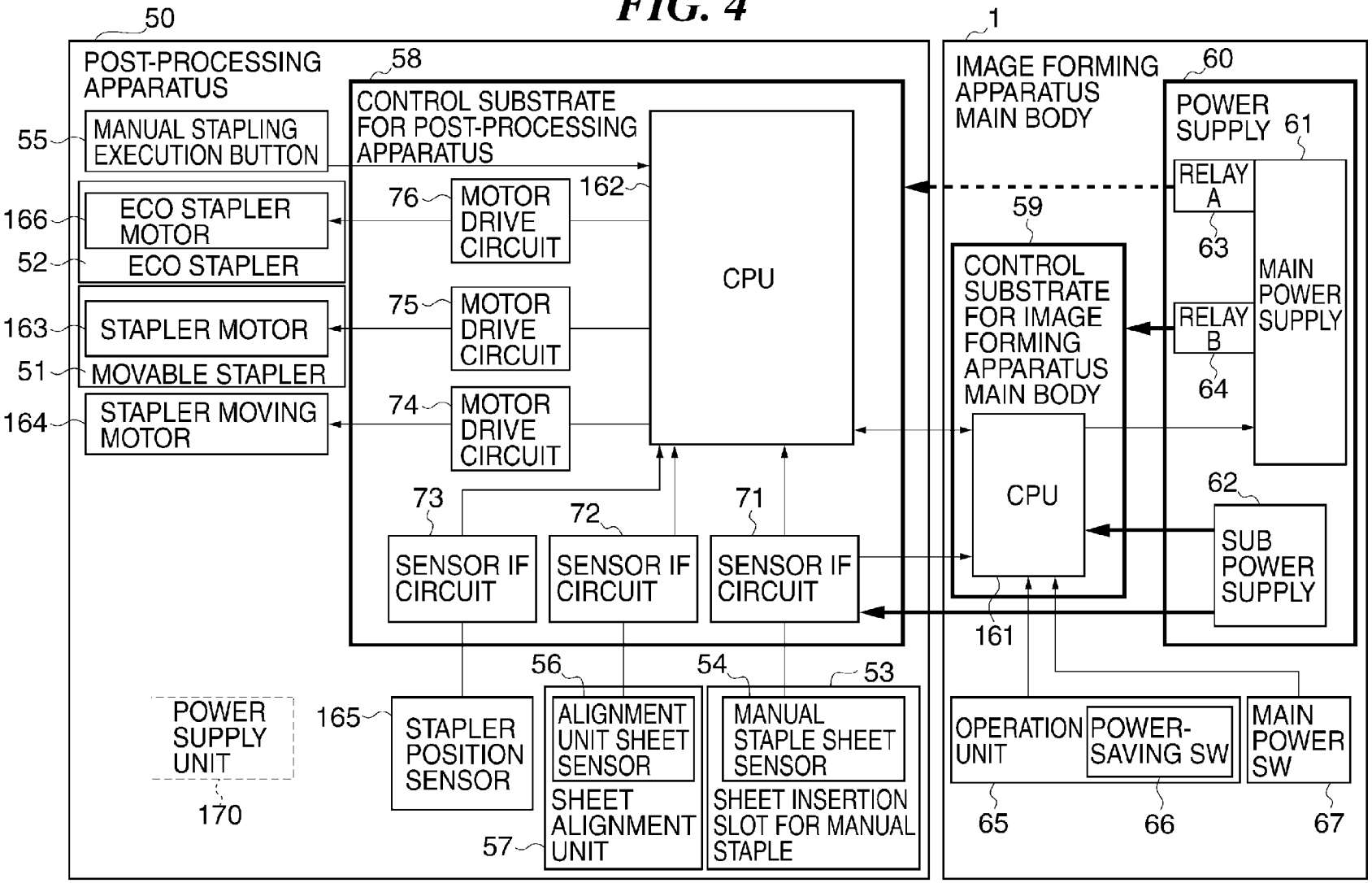
FIG. 4 is a diagram schematically showing arrangements of a control system of the image forming apparatus main body and a control system of the post-processing apparatus.

In the automatic stapling, the stapling process needs to be carried out in accordance with a stapling position set by the user of the post-processing apparatus 50. Thus, the stapling process is carried out at an arbitrary position among positions X1, X2, . . . Xn−1, Xn by moving the movable stapler 51 along the moving path 101 using a stapler moving motor 164 (FIG. 4). The number of positions X1, X2, . . . Xn−1, Xn that can be set for the movable stapler 51 vary according to product specifications of the post-processing apparatus 50.

On the other hand, in the manual stapling, the stapling process needs to be carried out on the sheets S2 inserted into the sheet insertion slot 53 by the user. The sheet insertion slot 53 is provided in a front surface of the post-processing apparatus 50. Therefore, to carry out the manual stapling on the sheets S2, the movable stapler 51 is moved to a position M on a front side of the post-processing apparatus 50 (a manual stapling position: a position at which the stapling process is carried out on sheets by a manual operation independently of an image forming operation).

If the movable stapler 51 is on a conveying path for the sheets S1, it will obstruct sheet conveyance. For this reason, when the stapling process is not to be carried out by the movable stapler 51, the movable stapler 51 needs to be retracted at a position X0 or position M, at which sheet conveyance is not obstructed, during conveyance of the sheets S1.

As described above, because the positions of the movable stapler 51 during execution of the automatic stapling and execution of the manual stapling are different, and hence the movable stapler 51 must be moved to an appropriate position according to whether the automatic stapling or the manual stapling is to be carried out. Moreover, assuming that the time period required to move the movable stapler 51 from the position X0 to the position M is five seconds, the waiting time that elapses before the automatic stapling or the manual stapling is performed varies according to the position at which the movable stapling 51 stands by.

A description will now be given of arrangements of a control system of the image forming apparatus main body 1 and a control system of the post-processing apparatus 50.

FIG. 4 is a block diagram schematically showing the arrangements of the control system of the image forming apparatus main body 1 and the control system of the post-processing apparatus 50.

Referring to FIG. 4, the image forming apparatus main body 1 has a control substrate 59 for a image forming apparatus main body, a power supply 60, and an operation unit 65.

The post-processing apparatus 50 has a control substrate 58 for a post-processing apparatus having a CPU 162 and others, the manual staple sheet sensor 54, a stapler position sensor 165, a stapler motor 163, the stapler moving motor 164, and so on.

The CPU 161 of the image forming apparatus main body 1 controls components of the image forming apparatus main body 1. The CPU 161 functions as described hereafter when insertion of sheets into the sheet insertion slot 53 is detected in a state in which the image forming apparatus main body 1 and the post-processing apparatus 50 has switched into a power-saving state. Specifically, the CPU 161 acts as a power control unit that holds the image forming apparatus main body 1 in the power-saving state, and returns the post-processing apparatus 50 from the power-saving state. The power supply 60 has a main power supply 61, a sub power supply 62, a relay A 63, and a relay B 64. The main power supply 61 is connected to the control substrate 58 via the relay A 63 and connected to the control substrate 59 via the relay B 64. The sub power supply 62 is connected to the CPU 161 of the control substrate 59 and a sensor interface (IF) circuit 71 of the control substrate 58.

The main power supply 61 is a power supply capable of supplying and shutting off power under the control of the CPU 161. The sub power supply 62 is a power supply which constantly supplies power in a state where a power plug of the image forming apparatus main body 1 is inserted in a power receptacle. The operation unit 65 is operated to configure various settings for the image forming apparatus main body 1 and the post-processing apparatus 50.

The CPU 162 of the post-processing apparatus 50 is connected to the CPU 161 of the image forming apparatus main body 1, and they carry out communications with each other to detect each other's device statuses. A manual staple execution button 55, the sensor interface (hereafter referred to as the IF) circuit 71, a sensor IF circuit 72, a sensor IF circuit 73, a motor drive circuit 74, a motor drive circuit 75, and a motor drive circuit 76. The CPU 162 of the post-processing apparatus 50 controls components of the post-processing apparatus 50 via the circuits mentioned above. The CPU 162 acts as a movement control unit that moves the movable stapler 51 to the manual stapling position when the post-processing apparatus 50 shifts into the power-saving state.

The alignment unit sheet sensor 56 detects the presence or absence of sheets in the sheet alignment unit 57 and notifies the CPU 162 of the detection result via the sensor IF circuit 72. The manual staple sheet sensor 54 detects the presence or absence of sheets in the sheet insertion slot 53 and notifies the CPU 162 of the detection result via the sensor IF circuit 71. The stapler position sensor 165, which is provided at a location opposed to the moving path 101 for the movable stapler 51 (see FIG. 3), acts as a position detection unit that detects a position of the movable stapler 51. The stapler position sensor 165 notifies the CPU 162 of the detection result via the sensor IF circuit 73.

The stapler motor 163, which is provided inside the movable stapler 51, is driven by the motor drive circuit 75 to drive the movable stapler 51. As a result, the stapling process is carried out on sheets. The stapler moving motor 164 is driven by the motor drive circuit 74 to move the movable stapler 51 to an arbitrary position as described above. The position of the movable stapler 51 is controlled by the CPU 162 based on results of detection by the stapler position sensor 165.

An eco stapler motor 166, which is provided inside the eco stapler 52, is driven by the motor drive circuit 76 to drive the eco stapler 52. As a result, the stapleless stapling process is carried out on sheets. When the manual staple execution button 55 is depressed by the user, the manual staple execution button 55 sends a signal corresponding to the depression to the CPU 162.

The post-processing apparatus 50 is supplied with electrical power from two systems, i.e. the main power supply 61, which is a first power supply constituting the power supply 60 of the image forming apparatus main body 1, and the sub power supply 62, which is a second power supply constituting the power supply 60 of the image forming apparatus main body 1. Specifically, when the post-processing apparatus 50 and the image forming apparatus main body 1 shift into a power-saving state, power is supplied as explained hereafter. In order to determine whether or not sheets have been inserted into the sheet insertion slot 53, electrical power is supplied to the manual staple sheet sensor 54 and the sensor IF circuit 71 from the sub power supply 62.

Here, the power-saving state means a state in which power consumption is lower than in a standby state in which image formation is not carried out and the image forming apparatus stands ready to form images. When the image forming apparatus 100 shifts into the power-saving state, power from the main power supply 61 is shut off, whereas the sub power supply 62 continues to supply power even when the image forming apparatus 100 shifts into the power-saving state.

Also, in order to determine whether or not the manual staple sheet sensor 54 has detected insertion of sheets into the sheet insertion slot 53, the CPU 161 of the image forming apparatus main body 1 as well is supplied with electrical power from the sub power supply 62. Power is supplied from the main power supply 61 to sensors other than the manual staple sheet sensor 54 of the post-processing apparatus 50 and the motor drive circuits 74 to 76. As a result, power to the post-processing apparatus 50 is selectively supplied or shut off based on a control signal from the CPU 161 of the image forming apparatus main body 1.

Although in the present embodiment, power to the post-processing apparatus 50 is supplied and shut off by the power supply 60 of the image forming apparatus main body 1, the present invention is not limited to this, but the post-processing apparatus 50 may be configured as shown in FIG. 4, for example. Specifically, the post-processing apparatus 50 may be equipped with a power supply unit 170, which supplies no power in the power-saving state, so that power to the post-processing apparatus 50 can be supplied and shut off by the power supply unit 170 based on control signals from the CPU 161 of the image forming apparatus main body 1. In this case as well, the same control as in the present embodiment can be realized.

With the arrangement described above, in the case where the image forming apparatus main body 1 and the post-processing apparatus 50 have shifted into the power-saving state, an operation is carried out as explained hereafter when sheets are manually inserted. When sheets are inserted into the sheet insertion slot 53 by the user, the manual staple sheet sensor 54 detects the sheets and outputs a detection signal to the CPU 161 of the image forming apparatus main body 1. The CPU 161 reads the detection signal and starts the main power supply 61 to supply electrical power to the control substrate 58. This enables the post-processing apparatus 50 to be returned from the power-saving state.

Referring next to FIG. 5, a description will be given the power-saving state and the standby state of the image forming apparatus main body 1 and the post-processing apparatus 50.

FIG. 5 is a view showing the power-saving state and the standby state of the image forming apparatus main body 1 and the post-processing apparatus 50.

Referring to FIG. 5, a state 1 is a state where both the image forming apparatus main body 1 and the post-processing apparatus 50 are in the standby state. In the state 1, considering that the movable stapler 51 carries out the automatic stapling, the movable stapler 51 stands by at a position in the rear of the post-processing apparatus 50 (the position X1 in FIG. 3). For this reason, the user cannot perform the manual stapling immediately after inserting sheets into the sheet insertion slot 53, but has to wait for a time period (for example, about five seconds) required for the movable stapler 51 to move from the position X1 to the position M appearing in FIG. 3.

In a state 2, the image forming apparatus main body 1 is in the power-saving state, and the post-processing apparatus 50 is in the standby state. In a state 4, both the image forming apparatus main body 1 and the post-processing apparatus 50 are in the power-saving state. The image forming apparatus main body 1 and the post-processing apparatus 50 shift into the state 2 in a case where only the manual stapling is to be carried out without carrying out image formation in the state 4 where both the image forming apparatus main body 1 and the post-processing apparatus 50 are in the power-saving state. At this time, the CPU 161 of the image forming apparatus main body 1 turns on the relay A 63 to supply electrical power from the main power supply 61 to the post-processing apparatus 50, thus starting up the post-processing apparatus 50 with the image forming apparatus main body 1 being held in the power-saving state.

In a state 3, the image forming apparatus main body 1 is in the standby state, and the post-processing apparatus 50 is in the power-saving state. The CPU 161 of the image forming apparatus main body 1 turns on the relay B 64 to start up only the image forming apparatus main body 1 and hold the post-processing apparatus 50 in the power-saving state.

When the image forming apparatus main body 1 has a plurality of sheet discharge ports and can be used independently of the post-processing apparatus 50, or in a mode where the sheet discharge port of the post-processing apparatus 50 is not used (a mode in which, for example, only an image sending function is executed), the image forming apparatus main body 1 and the post-processing apparatus 50 may shift into the state 3.

The present embodiment is particularly characterized by the following operations of the post-processing apparatus 50 in the state 3 (the image forming apparatus main body 1: standby state, the post-processing apparatus 50: power-saving state) and the state 4 (the image forming apparatus main body 1 and the post-processing apparatus 50: power-saving state). Namely, the present embodiment is characterized by operations of the post-processing apparatus 50 when it shifts into the power-saving state and returns from the power-saving state.

Specifically, when the post-processing apparatus 50 is to shift into the power-saving state, the post-processing apparatus 50 shifts into the power-saving state after the movable stapler 51 is moved to the position M by the stapler moving motor 164. After that, triggered by a signal generated when insertion of sheets into the sheet insertion slot 53 is detected by the manual staple sheet sensor 54, the manual stapling is carried out as explained hereafter. That is, the post-processing apparatus 50 returns from the power-saving state to the standby state with the image forming apparatus main body 1 being held in the power-saving state.

As a result, although there has conventionally been a waiting time until the image forming apparatus main body 1 is started up, it becomes unnecessary to wait, and hence the time period required for the post-processing apparatus 50 to return from the power-saving state can be shortened. Moreover, because the time for which the movable stapler 51 moves is eliminated, stress on the user can be reduced. Further, because it is unnecessary to drive the stapler moving motor 164, power can be saved, as the image forming apparatus main body 1 is in the power-saving state.

Referring next to flowcharts of FIGS. 6A and 6B, a detailed description will be given of a process carried out by the CPU 161 of the image forming apparatus main body 1 in relation to the operation of the image forming apparatus main body 1 and the post-processing apparatus 50 described above.

Figure 6A:
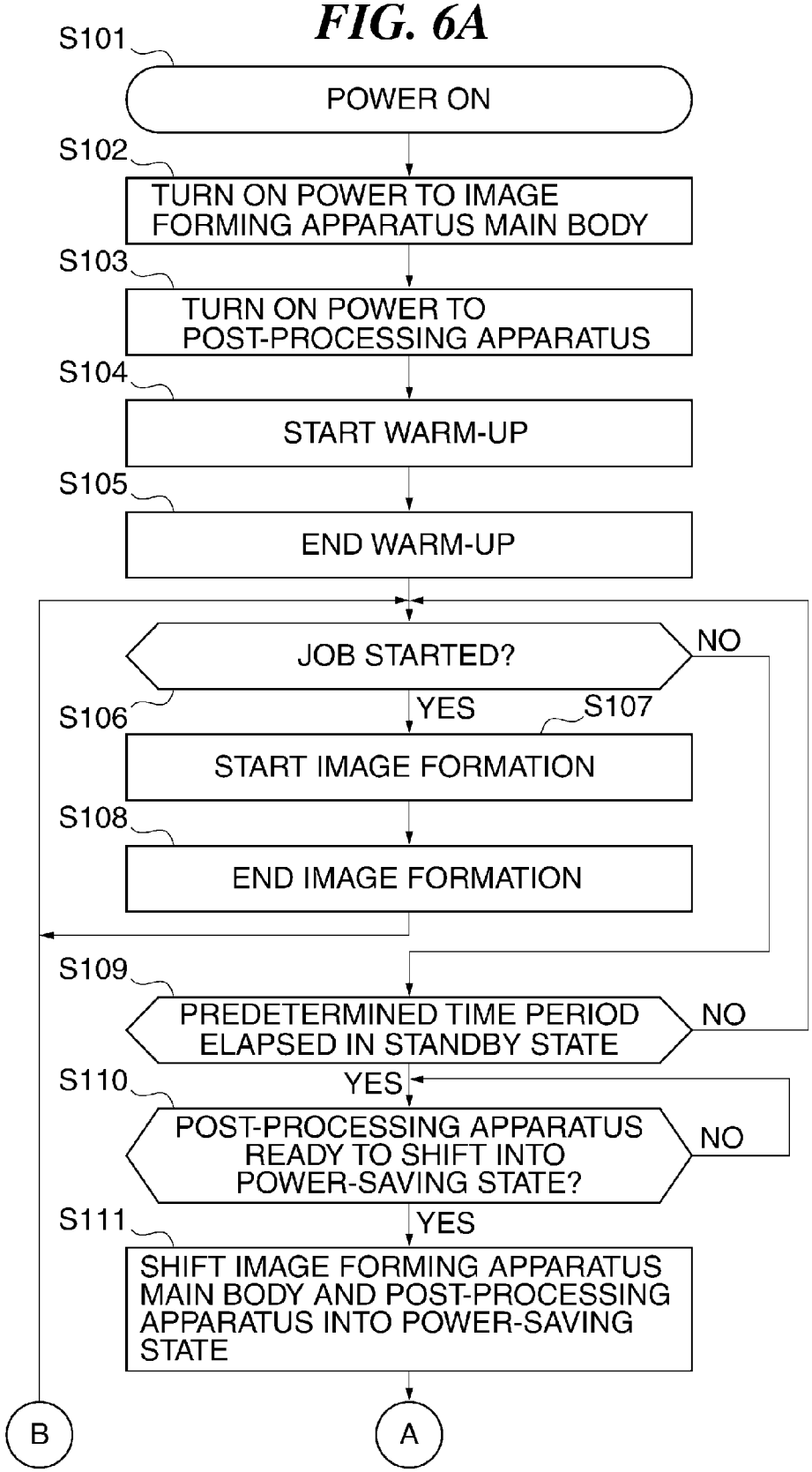
FIGS. 6A and 6B are flowcharts of a process carried out by a CPU of the image forming apparatus main body.
Figure 6B:
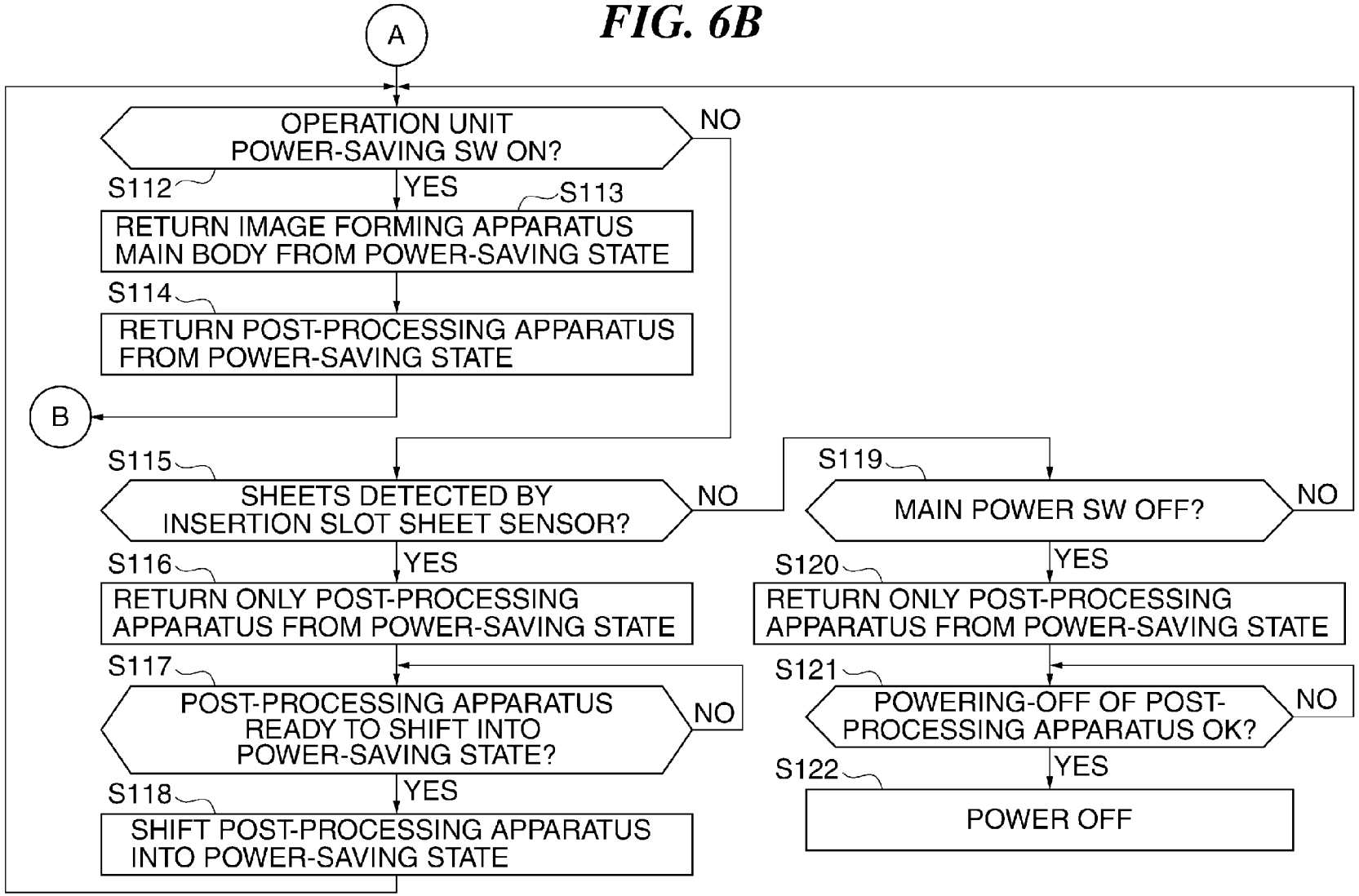

FIGS. 6A and 6B are flowcharts of the process carried out by the CPU 161 of the image forming apparatus main body 1.

Referring to FIGS. 6A and 6B, when the user turns on a power switch of the operation unit 65 of the image forming apparatus main body 1 (step S101), the CPU 161 of the image forming apparatus main body 1 carries out a process explained hereafter. The CPU 161 turns on a power system (main body power system) for the image forming apparatus main body 1 to start up the image forming apparatus main body 1 (step S102) and then turns on a power system for the post-processing apparatus 50 to start up the post-processing apparatus (step S103). The CPU 161 then starts warm-up of the image forming apparatus main body 1 (step S104), and when the temperature of the fixing device reaches a target temperature, finishes warm-up of the image forming apparatus main body 1 (step S105).

The CPU 161 then determines whether or not an image formation job has been started (step S106). When an image formation job has been started, the CPU 161 causes the image forming unit 3, which has been described with reference to FIG. 1, to start image formation (step S107), then terminates image formation (step S108), and shifts into a state of waiting for starting of the image formation job in the step S106.

When an image formation job has not been started, the CPU 161 determines whether or not a predetermined time period has elapsed in a state of waiting for starting of an image formation job (standby state) (step S109). When the predetermined time period has not elapsed, the CPU 161 continues to be in the state of waiting for starting of an image formation job in the step S106. When the predetermined time period has elapsed, the CPU 161 instructs the post-processing apparatus 50 to shift into the power-saving state and waits for information, which is indicative of whether or not the post-processing apparatus 50 is ready to shift into the power-saving state, from the post-processing apparatus 50 (step S110).

When the post-processing apparatus 50 is not ready to shift into the power-saving state, the CPU 161 continues to wait for the information from the post-processing apparatus 50 (step S110). When the post-processing apparatus 50 is ready to shift into the power-saving state, the CPU 161 shuts off power from the main power supply 61 to the image forming apparatus main body 1 and the post-processing apparatus 50 and brings both of them into the power-saving state (step S111). Next, when a power-saving switch 66 provided on the operation unit 65 of the image forming apparatus main body 1 is turned on when the image forming apparatus main body 1 and the post-processing apparatus 50 are in the power-saving state (step S112), the CPU 161 carries out a process described hereafter. Specifically, the CPU 161 returns the image forming apparatus main body 1 from the power-saving state (step S113).

It should be noted that when the power-saving switch 66 is turned on in the standby state, the image forming apparatus main body 1 and the post-processing apparatus 50 shifts into the power-saving state. Specifically, when the image forming apparatus main body 1 is in the power-saving state, the power-saving switch 66 acts as a switch that inputs an instruction for canceling the power-saving state. It should be noted that the location at which the power-saving switch 66 is placed should not always be on the operation unit 65.

The CPU 161 then returns the post-processing apparatus 50 from the power-saving state (step S114). After that, the CPU 161 shifts into the state of waiting for starting of an image formation job in the step S106. When the power-saving switch 66 on the operation unit 65 of the image forming apparatus main body 1 is not depressed in the step S112, the CPU 161 determines whether or not the manual staple sheet sensor 54 has detected insertion of sheets into the sheet insertion slot 53 by the user (step S115).

When the manual staple sheet sensor 54 has detected insertion of sheets into the sheet insertion slot 53, the CPU 161 cancels the power-saving state of the post-processing apparatus 50 while holding the image forming apparatus main body 1 in the power-saving state (step S116). The CPU 161 then waits for information, which is indicative of whether or not the post-processing apparatus 50 is ready to switch into the power-saving state, from the post-processing apparatus 50 (step S117). When the post-processing apparatus 50 is ready to shift into the power-saving state, the CPU 161 carries out a process described hereafter.

Specifically, the CPU 161 shuts off power from the main power supply 61 to the post-processing apparatus 50, causing the post-processing apparatus 50 to shift into the power-saving state (step S118), and determines whether or not the power-saving switch 66 on the operation unit 65 has been depressed (step S112). When in the step S115, the manual staple sheet sensor 54 has not detected insertion of sheets into the sheet insertion slot 53, the CPU 161 determines whether or not a main power switch 67 for the image forming apparatus main body 1 has been turned off (step S119). The main power switch 67 is a switch for turning on and off power to the post-processing apparatus 50 and the image forming apparatus main body 1, that is, power to the image forming apparatus 100. When the main power switch 67 is turned off, this means that the user has issued an instruction to shut off power.

When the CPU 161 determines that the main power switch 67 has been turned off, the CPU 161 returns only the post-processing apparatus 50 from the power-saving state so as to normally shut down the post-processing apparatus 50 (step S120). When the post-processing apparatus 50 is ready to be powered off (step S121), the CPU 161 shuts off power to the components of the post-processing apparatus 50 which are supplied with electrical power from the sub power supply 62, and terminates the present process (step S122). When the main power switch 67 has not been turned off, the CPU 161 goes to the step of determining whether or not the power-saving switch 66 on the operation unit 65 has been depressed with the image forming apparatus main body 1 and the post-processing apparatus 50 being in the power-saving state (step S112).

The flowcharts of FIGS. 6A and 6B are just examples, and the same operations can be realized even in the following sequence. For example, the steps S112, S115, and S119, which are determination steps executed when the image forming apparatus main body 1 and the post-processing apparatus 50 are in the power-saving state may be in random order. When the steps S112 and S115 occur at the same time, a higher priority may be given to either of them and may be set by the user.

Referring to next flowcharts of FIGS. 7A and 7B, a detailed description will be given of a process carried out by the CPU 162 of the post-processing apparatus 50.

Figure 7A:
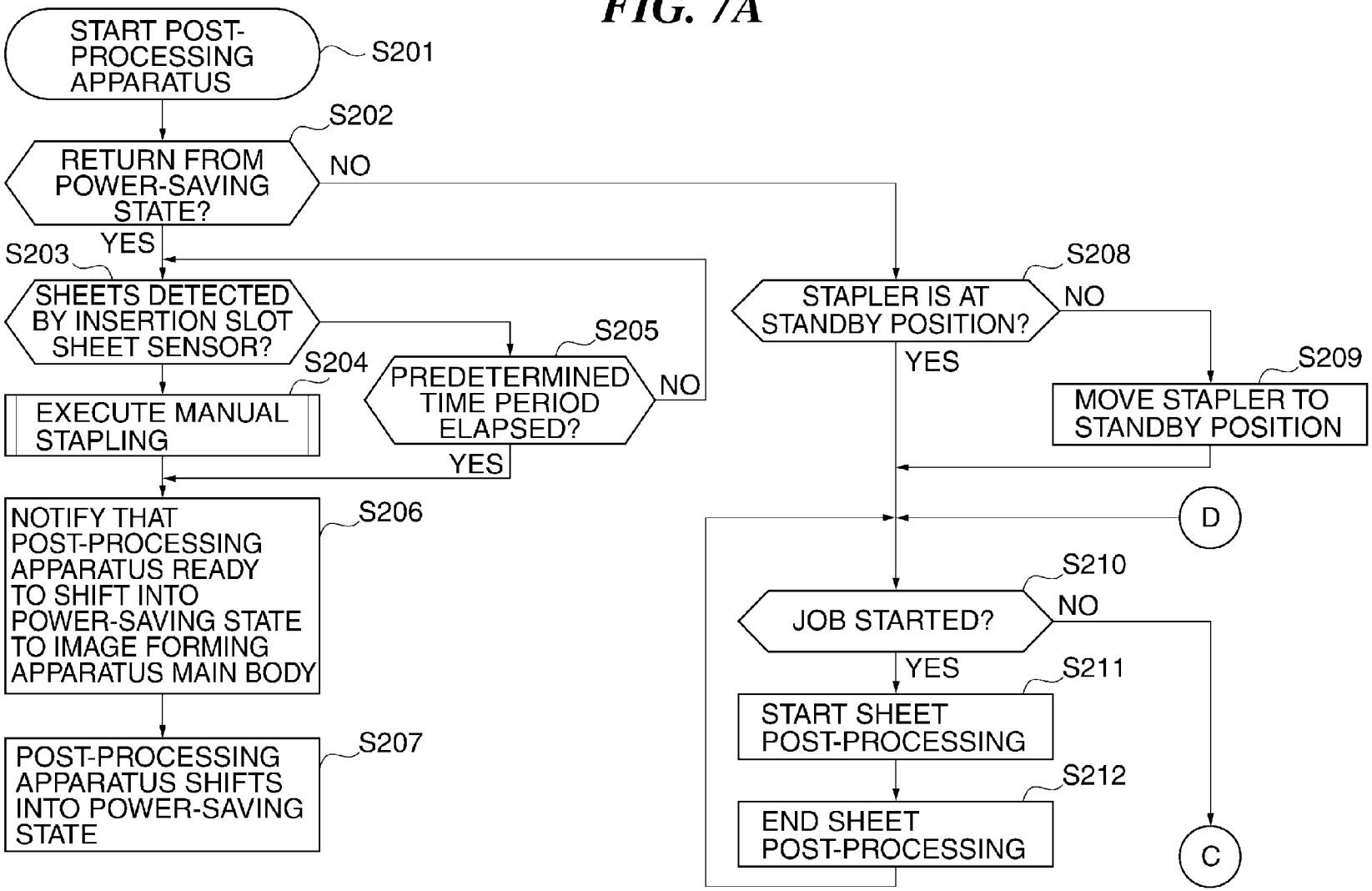
FIGS. 7A and 7B are flowcharts of a process carried out by a CPU of the post-processing apparatus.
Figure 7B:
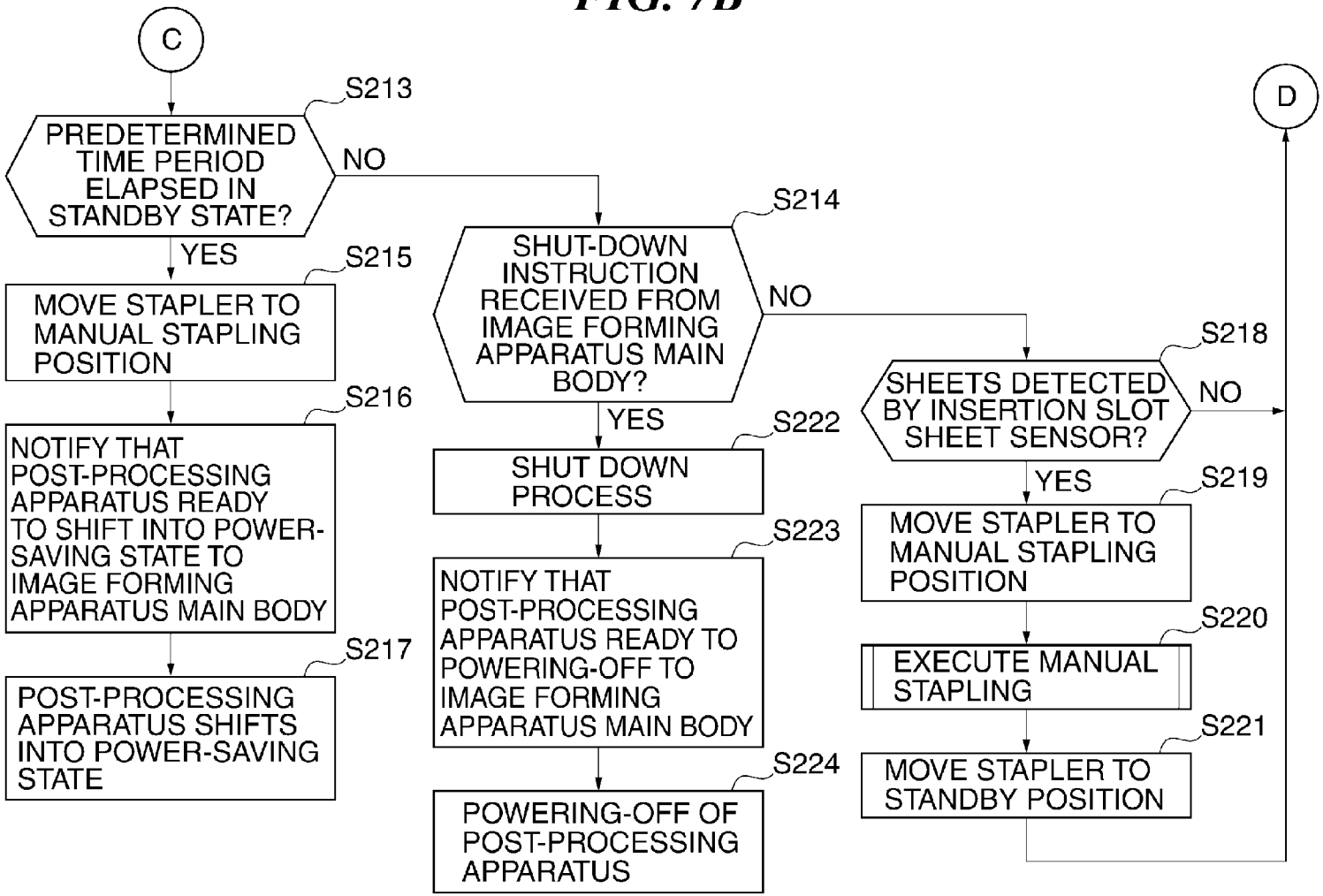

FIGS. 7A and 7B are flowcharts showing the process carried out by the CPU 162 of the post-processing apparatus 50.

Referring to FIGS. 7A and 7B, when the post-processing apparatus 50 is started (step S201), the CPU 162 of the post-processing apparatus 50 communicates with the CPU 161 of the image forming apparatus main body 1 to determine whether or not the post-processing apparatus 50 has returned from the power-saving state (step S202). When the post-processing apparatus 50 has returned from the power-saving state, the CPU 162 determines whether or not the manual staple sheet sensor 54 has detected insertion of sheets into the sheet insertion slot 53 by the user (step S203).

When the manual staple sheet sensor 54 has detected insertion of sheets into the sheet insertion slot 53, the CPU 162 carries out a manual stapling process (FIG. 8), to be described later (step S204). When the manual stapling process is completed, the CPU 162 notifies the image forming apparatus main body 1 that the post-processing apparatus 50 is ready to shift into the power-saving state (step S206). When the manual staple sheet sensor 54 has not detected insertion of sheets into the sheet insertion slot 53, the CPU 162 determines whether or not a predetermined time period has elapsed since the return from the power-saving state (step S205).

When the predetermined time period has elapsed, the CPU 162 notifies the image forming apparatus main body 1 that the post-processing apparatus 50 is ready to shift into the power-saving state (step S206). When the predetermined time period has not elapsed, the CPU 162 goes to the step of determining whether or not the manual staple sheet sensor 54 has detected insertion of sheets into the sheet insertion slot 53 (step S203).

After the CPU 162 notifies the image forming apparatus main body 1 in the step S206 that the post-processing apparatus 50 is ready to shift into the power-saving state, power from the main power supply 61 of the image forming apparatus main body 1 to the post-processing apparatus 50 is shut off. As a result, the post-processing apparatus 50 shifts into the power-saving state (step S207).

When in the step S202, starting of the post-processing apparatus 50 is caused not by return from the power-saving state but by turning-on of the main power switch 67 of the image forming apparatus 100, the CPU 162 makes a determination described hereafter. The CPU 162 determines whether or not the stapler position sensor 165 has detected the movable stapler 51 being at the standby position (X1 in FIG. 2) (step S208). When the movable stapler 51 being not at the standby position, the CPU 162 moves the movable stapler 51 to the standby position (step S209). In the standby state as well, when the manual staple sheet sensor 54 has not detected insertion of sheets into the sheet insertion slot 53, and the movable stapler 51 is not at the standby position, the CPU 162 moves the movable stapler 51 to the standby position.

In either the case where the movable stapler 51 is at the standby position in the step S208 or the case where the movable stapler 51 is moved to the standby position in the step S209, the CPU 162 determines whether or not a post-processing job has been started (step S210). When a post-processing job has been started, the CPU 162 starts predetermined sheet post-processing in the post-processing apparatus (step S211) and ends the sheet post-processing (step S212). After that, the CPU 162 goes to the step of determining again whether or not a post-processing job has been started (step S210).

When a post-processing job has not been started in the step S210, the CPU 162 determines whether or not a predetermined time period has elapsed in a state in which the movable stapler 51 being in the standby state is at the standby position (step S213). When the predetermined time period has elapsed, the CPU 162 moves the movable stapler 51 to a manual stapling position (M in FIG. 2) and notifies the image forming apparatus main body 1 that the post-processing apparatus 50 is ready to shift into the power-saving state (step S216). As a result, power from the main power supply 61 of the image forming apparatus main body 1 to the post-processing apparatus 50 is shut off, and the post-processing apparatus 50 shifts into the power-saving state (step S217).

When the predetermined time period has not elapsed, the CPU 162 determines whether or not there has been a shutdown instruction from the image forming apparatus main body 1 (step S214). When there has been a shutdown instruction from the image forming apparatus main body 1, the CPU 162 carries out a process to shut down the post-processing apparatus 50 (step S222) and then notifies the image forming apparatus main body 1 that power to the post-processing apparatus 50 is ready to be shut off (step S223). After that, power from the sub power supply 62 and the main power supply 61 of the image forming apparatus main body 1 to the post-processing apparatus 50 is shut off (step S224).

When there has been no shutdown instruction from the image forming apparatus main body 1, the CPU 162 determines whether or not the manual staple sheet sensor 54 has detected insertion of sheets into the sheet insertion slot 53 by the user (step S218). When the manual staple sheet sensor 54 has detected insertion of sheets into the sheet insertion slot 53, the CPU 162 moves the movable stapler 51 from the standby position (X1 in FIG. 2) to the manual stapling position (M in FIG. 2) (step S219).

The CPU 162 then carries out a manual stapling process (FIG. 8) using the movable stapler 51 as will be described later (step S220) and drives the stapler moving motor 164 to move the movable stapler 51 to the standby position (X1 in FIG. 2). After that, the CPU 162 shifts into the state of waiting for starting of a post-processing job in the step S210. Likewise, when the manual staple sheet sensor 54 has not detected insertion of sheets into the sheet insertion slot 53, the CPU 162 shifts into the state of waiting for starting of a post-processing job in the step S210.

Referring next to a flowchart of FIG. 8, a description will be given of the manual stapling process carried out by the post-processing apparatus 50.

Figure 8:
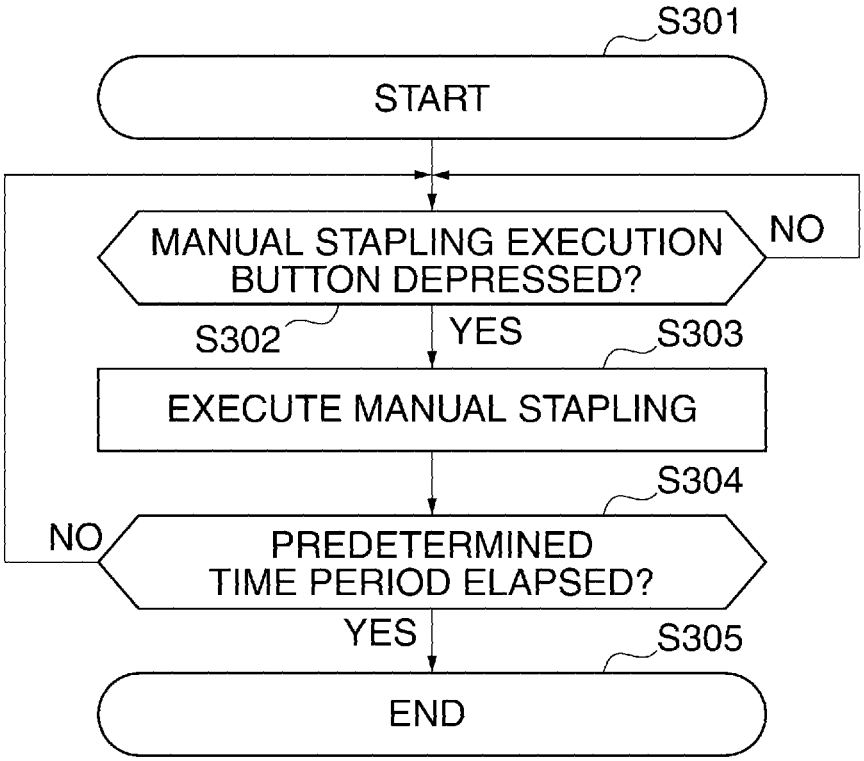
FIG. 8 is a flowchart of a manual stapling process.

FIG. 8 is a flowchart of the manual stapling process.

Referring to FIG. 8, when the CPU 162 of the post-processing apparatus 50 starts the manual stapling process (step S301), the CPU 162 of the post-processing apparatus 50 determines whether or not the manual staple execution button 55 has been depressed by the user (step S302). When the manual staple execution button 55 has been depressed, the CPU 162 carries out the manual stapling on sheets using the movable stapler 51 being at the manual stapling position (step S303).

The CPU 162 then determines whether or not a predetermined time period has elapsed since the manual stapling was started (step S304). When the predetermined time period has elapsed, the CPU 162 terminates the manual stapling process (step S305). With consideration given to the possibility of continuously carrying out the manual stapling process, the CPU 162 goes to the step of determining whether or not the manual staple execution button 55 has been depressed until the predetermined time period has elapsed (step S302).

Thus, the timer period required for the post-processing apparatus 50 since return from the power-saving state until carrying out the manual stapling can be reduced, and hence a post-processing apparatus with enhanced user convenience can be offered. Moreover, according to this arrangement, because power consumption can be reduced by returning only the post-processing apparatus 50 into the power-saving state, a post-processing apparatus with improved power-saving performance can be offered.

As described above, according to the present embodiment, when the image forming apparatus main body 1 and the post-processing apparatus 50 shift into the power-saving state, the standby position of the movable stapler 51 is changed to the manual stapling position. Moreover, when the manual staple sheet sensor 54 has detected insertion of sheets into the sheet insertion slot 53, only the post-processing apparatus 50 is returned from the power-saving state to carry out the manual stapling on the sheets. As a result, the time period for which the user has to wait when carrying out a stapling process on sheets by a manual operation can be reduced. Moreover, because only the post-processing apparatus 50 is returned from the power-saving state, power consumption can be reduced.

OTHER EMBODIMENTS

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-034813 filed Feb. 25, 2013, which is hereby incorporated by reference herein in its entirety.

What is claimed is:

1. An image forming system having an image forming apparatus, which forms images on sheets, and a sheet post-processing apparatus, which carries out a stapling process on the sheets having the images formed thereon by the image forming apparatus, and is configured to be able to shift into a power-saving state in which power consumption is lower than in a standby state in which image formation is not performed, comprising:

a stapling unit configured to be able to carry out a manual stapling process in which sheets set by a manual operation are stapled independently of an image forming operation and an automatic stapling process in which sheets are stapled associated with the image forming operation, and to move along a path including a manual stapling position for the manual stapling process and an automatic stapling position for the automatic stapling process;

a sheet setting unit into which the sheets on which the manual stapling process is to be carried out are set;

a detection unit configured to detect that the sheets have been set into said sheet setting unit;

a movement control unit configured to move said stapling unit to the manual stapling position when the sheet post-processing apparatus is to shift into the power-saving state; and a power control unit configured to, when it is detected that the sheets have been set into said sheet setting unit by said detection unit in a state in which the image forming apparatus and the sheet post-processing apparatus have shifted into the power-saving state, hold the image forming apparatus in the power-saving state and return the sheet post-processing apparatus from the power-saving state.

2. The image forming system according to claim 1, further comprising:

a power supply configured to supply electrical power to the image forming apparatus and the sheet post-processing apparatus; and a switch configured to return the image forming apparatus and the sheet post-processing apparatus from the power-saving state, wherein, in a case where said switch is operated in a state in which the image forming apparatus and the sheet post-processing apparatus have shifted into the power-saving state, said power control unit returns the image forming apparatus and the sheet post-processing apparatus from the power-saving state.

3. The image forming system according to claim 2, wherein said power supply comprises a first power supply that supplies no electrical power in which the image forming apparatus and the sheet post-processing apparatus have shifted into the power-saving state, and a second power supply that supplies electrical power even in a state in which the image forming apparatus and the sheet post-processing apparatus have shifted into the power-saving state, and the second power supply supplies electrical power to at least said detection unit and said power control unit.

4. The image forming system according to claim 3, wherein the second power supply is provided in the image forming apparatus.

5. The image forming system according to claim 1, wherein after the sheet post-processing apparatus returns from the power-saving state to carry out the manual stapling process, said power control unit causes the sheet post-processing apparatus to shift into the power-saving state.

6. The image forming system according to claim 1, wherein in a case where the sheet post-processing apparatus is in the standby state, said movement control unit moves said stapling unit to a standby position, which is different from the manual stapling position, when said detection unit has not detected sheets, and said stapling unit is not at the standby position.

7. A sheet post-processing apparatus that is configured to be able to shift into a power-saving state in which power consumption is lower than in a standby state in which image formation is not performed, comprising:

a stapling unit configured to carry out a manual stapling process in which sheets set by a manual operation are stapled independently of an image forming operation and an automatic stapling process in which sheets are stapled associated with the image forming operation, and to move along a path including a manual stapling position for the manual stapling process and an automatic stapling position for the automatic stapling process;

a sheet setting unit into which the sheets on which the manual stapling process is to be carried out are set;

a detection unit configured to detect that the sheets have been set into said sheet setting unit; and a movement control unit configured to move said stapling unit to the manual stapling position when the sheet post-processing apparatus is to shift into the power-saving state; and wherein in a case where it is detected that the sheets have been set into said sheet setting unit by said detection unit in a state in which the image forming apparatus and the sheet post-processing apparatus have shifted into the power-saving state, the sheet post-processing apparatus returns from the power-saving state independently of the image forming apparatus.

8. The sheet post-processing apparatus according to claim 7, wherein said detection unit is supplied electrical power from the image forming apparatus even when the sheet post-processing apparatus is in the power-saving state.

9. The sheet post-processing apparatus according to claim 7, wherein after the sheet post-processing apparatus returns from the power-saving state to carry out the manual stapling process, the sheet post-processing apparatus shifts into the power-saving state.

10. The sheet post-processing apparatus according to claim 7, wherein in a case where the sheet post-processing apparatus is in the standby state, said movement control unit moves said stapling unit to a standby position, which is different from the manual stapling position, when said detection unit has not detected sheets, and said stapling unit is not at the standby position.

11. A control method for an image forming system having an image forming apparatus which forms images on sheets, and a sheet post-processing apparatus which is configured to be able to shift into a power-saving state in which power consumption is lower than in a standby state in which image formation is not performed, the sheet post-processing apparatus having a stapling unit configured to be able to carry out a manual stapling process in which sheets set by a manual operation are stapled independently of the image forming operation and an automatic stapling process in which sheets are stapled associated with the image forming operation, and to move along a path including a manual stapling position for the manual stapling process and an automatic stapling position for the automatic stapling process, a sheet setting unit into which the sheets on which the manual stapling process is to be carried out are set, and a detection unit configured to detect that the sheets have been set into the sheet setting unit, the control method comprising:

a movement control step of moving the stapling unit to the manual stapling position when the sheet post-processing apparatus is to shift into the power-saving state; and a power control step of, when it is detected that the sheets have been set into the sheet setting unit by the detection unit in a state in which the image forming apparatus and the sheet post-processing apparatus have shifted into the power-saving state, holding the image forming apparatus in the power-saving state and returning the sheet post-processing apparatus from the power-saving state.

* * * * *